United States Patent [19]

Atkins et al.

[11] Patent Number: 4,913,089

[45] Date of Patent: Apr. 3, 1990

[54] CONCRETE INJECTOR PUMP AND PROCESS FOR LINING PIPE

[75] Inventors: Tom G. Atkins; Don E. Gray, both of Birmingham; George H. Styles, Kimberly, all of Ala.

[73] Assignee: American Cast Iron Pipe Company, Birmingham, Ala.

[21] Appl. No.: 225,779

[22] Filed: Jul. 29, 1988

[51] Int. Cl.[4] ..... B05C 1/02; B05C 7/02

[52] U.S. Cl. ..... 118/680; 118/683; 118/684; 118/697; 118/702; 118/317; 239/69; 239/302; 239/743

[58] Field of Search ..... 417/900 X, 403, 507, 417/317 X; 118/317, 318, 697, 704, 705, 306, 688, 679, 680, 681, 682, 696, 699, 702, 684, 683; 425/470, 110, 161, 155, 392, 397; 239/66, 67, 69, 302, 743

[56] References Cited

U.S. PATENT DOCUMENTS

| | | | |
|---|---|---|---|
| 1,538,166 | 5/1925 | Cass | 417/559 |
| 2,393,096 | 1/1946 | Fitzgerald | 417/900 |
| 3,323,462 | 6/1967 | Turzillo et al. | 417/404 |
| 3,327,641 | 6/1967 | Klosterman | 417/507 |
| 3,398,693 | 8/1968 | Schumann | 417/507 |
| 3,476,057 | 11/1969 | McElroy | 417/498 |
| 3,552,440 | 1/1971 | Smith | 417/519 |
| 3,659,970 | 5/1972 | McElroy | 417/516 |
| 3,663,129 | 5/1972 | Antosh | 417/516 |
| 3,667,869 | 6/1972 | Schlecht | 417/900 |
| 3,811,802 | 5/1974 | Semple | 417/454 |
| 3,827,633 | 8/1974 | Kouno et al. | 118/306 |
| 3,994,631 | 11/1976 | Hostetter | 417/506 |
| 4,067,666 | 1/1978 | Richards | 417/265 |
| 4,140,443 | 2/1979 | Olson | 417/345 |
| 4,167,374 | 9/1979 | Smith | 417/318 |
| 4,290,737 | 9/1981 | Clay | 417/403 |
| 4,321,016 | 3/1982 | Sakamoto et al. | 417/63 |
| 4,358,257 | 11/1982 | Seiler et al. | 417/517 |
| 4,437,817 | 3/1984 | Metzelder | 417/507 |
| 4,597,995 | 7/1986 | Snow et al. | 427/231 |
| 4,605,356 | 8/1986 | Uchida et al. | 417/900 |
| 4,613,290 | 9/1986 | Evenson | 417/900 |
| 4,614,300 | 9/1986 | Falcoff | 239/302 |
| 4,637,547 | 1/1987 | Hiniker et al. | 239/69 |
| 4,807,664 | 2/1989 | Wilson et al. | 239/69 |
| 4,830,230 | 5/1989 | Powers | 417/403 |

*Primary Examiner*—Willard Hoag

*Attorney, Agent, or Firm*—Kerkam, Stowell, Kondracki & Clarke.

[57] ABSTRACT

A computer controlled concrete injector pump and process for lining pipe comprises a pump chamber having an outlet connected to a spray lance through a first check valve and having first and second inlets, one inlet being connected through a second check valve to a hopper, and the second inlet being connected to an injector tube having a piston moveable therein by a hydraulic cylinder. The hydraulic cylinder is controlled by a programmable logic controller in a control system which has provisions for operator input of lining process parameters. The volume and flow rate of material from the pump may be controlled accurately by controlling the movement of the piston within the injector tube. The valve housing of the second check valve between the chamber and the hopper is split into two portions which are connected by a quick-disconnect coupling. The valve housing may be separated for access to its interior for maintenance and cleaning.

15 Claims, 3 Drawing Sheets

CONCRETE INJECTOR PUMP AND PROCESS FOR LINING PIPE

BACKGROUND OF THE INVENTION

The present invention relates generally to pumps for viscous slurries, such as concrete, and more particularly to an apparatus and method for lining pipe with concrete using such a pump.

It is common to apply concrete or other corrosion-resistant linings to the interior surfaces of metal pipe. Small diameter pipe, up to sixteen inch diameter, for example, may be lined by depositing the lining material onto the interior surface of the pipe using a spray lance, and rotating the pipe to distribute the lining material about the interior surface and compact the lining material using centrifugal force. The spray lance may comprise a hollow tube having a spray nozzle at one end which is inserted into the pipe and advanced over the length of pipe as the lining material is pumped through the hollow tube to the spray nozzle and sprayed onto the surface of the pipe. As may be appreciated, it is desirable that the lining have a predetermined thickness and that the lining thickness be substantially constant over the length of the pipe. This requires the delivery of a predetermined quantity of lining material by the pump and reasonably close control over the pump so that the delivery of the lining material is accurately controlled and synchronized with the movement of the lance. Moreover, the pump must be a constant flow surgeless pump since any change in pump pressure and the flow rate from the pump would result in skips or thin spots in the lining.

Pumps which are capable of pumping viscous slurries such as concrete which have these and other desirable characteristics and features are difficult to find. Most known pumps for concrete mixtures and the like do not afford sufficiently accurate control over the starting and stopping of the flow to give linings having the desired characteristics. In addition, concrete mixtures are abrasive, and pump wear may result in a change in the flow rate from the pump, thereby necessitating close monitoring and control to insure that a predetermined flow rate is maintained. For pipe lining operations, it is desireable to be able to employ a concrete mixture having a relatively high sand-to-cement ratio. Most known types of concrete pumps have difficulty pumping mixtures having a high sand-to-cement ratio without the pump binding. It is also necessary that the pump be capable of easy cleaning since if the concrete mixture is allowed to harden within the pump, it could ruin the pump.

It is desirable to provide pumps for viscous slurries such as concrete and the like and to provide a method for pipe lining employing such a pump which avoid the foregoing and other disadvantages of known pumps and methods, and it is to these ends that the present invention is directed.

SUMMARY OF THE INVENTION

In one aspect, the invention affords a new and improved pump for pumping a viscous slurry, such as a concrete mixture, which is particularly well adapted for use in a pipe lining process. The pump of the invention is surgeless and capable of providing a flow rate which is constant with time and which does not vary over the pump stroke cycle. Accordingly, the pump is capable of providing a predetermined quantity of lining material in a manner which can be controlled quite accurately. As a result, when used in a pipe lining process, the pump affords a lining which is free of skips or thin spots. Furthermore, concrete is an abrasive mixture, and as pump wear occurs as a result of pumping such a mixture, the flow rate does not change. This enables the pump to be computer controlled quite accurately since it is unnecessary to compensate for variations in flow rate due to pump wear.

Other advantages and features of the pump include the ability to pump mixtures having a wide variation in mixture parameters, such as sand-to-cement ratio, and the ability to avoid exit port blockage or chamber volume reduction due to the buildup within the pump of sand which separates from the concrete mixture. The pump avoids such blockage and chamber volume reduction by a construction which does not afford an opportunity for sand separated from the mixture to buildup within the pump and which enables any sand separated to be ejected along with the mixture. Also, the pump is designed for easy access to its interior, which facilitates cleaning.

A pump in accordance with the invention for pumping a slurry which affords these features may comprise a chamber having an outlet and having first and second inlets, a hopper for containing the slurry which is to be pumped, a fill valve disposed between the first inlet and the hopper, and injector means comprising a tube and a moveable plunger connected to the second inlet. The fill valve comprises a valve housing which provides a passageway between the hopper and the first inlet, and which encloses a moveable check valve for opening and closing the passageway. The valve housing is split into two parts which are held together by a quick-disconnect coupling and which are separable for easy access to the interior for cleaning. Means is also included for moving the plunger of the injector means in a first direction to draw into the injector tube and the chamber through the fill valve a quantity of the slurry, and for moving the plunger in a second opposite direction to eject the slurry from the outlet of the chamber.

The injector means of the pump operates somewhat similar to a syringe. When the plunger is withdrawn by moving it in the first direction, the slurry is drawn through the fill valve into the chamber and into the injector tube. The tube is sized so that it is capable of holding a charge of slurry that is greater than that necessary to line one pipe and, preferably, is sufficient for lining several pipes. When the plunger is moved in the opposite direction (pushed in), the check valve element of the fill valve closes and the slurry within the injector tube and chamber is forced through the outlet of the chamber. The quantity of material supplied by the pump and the rate at which it is applied may be conveniently controlled by controlling the movement of the plunger. The quantity of lining material delivered is proportional to the amount of inward movement of the plunger, and the flow rate is proportional to the rate of movement of the plunger. As a result, the delivery of material from the pump may be started and stopped quite accurately.

By combining the pump with a spray lance and means for advancing the lance into a length of pipe at a controlled speed, the invention affords a highly advantageous process for lining pipe which comprises inserting smoothly in one continuous motion and at a controlled speed a spray lance into the interior of a length of pipe, supplying a predetermined quantity of lining material to the spray lance at a predetermined rate determined by the speed of advancement of the lance into the pipe, the predetermined quantity of lining material being determined by the thickness of the lining to be deposited, and said supplying comprises filling an injector tube having a moveable plunger with lining material, and pumping the lining material to the lance by moving the plunger inwardly a predetermined amount and at a controlled rate in synchronism with the advancement of the lance into the pipe.

The foregoing and other advantages and features of the invention will become apparent from the description which follows.

DESCRIPTION OF A PREFERRED EMBODIMENT

The invention is particularly well adapted to the lining of metal pipe with concrete, and will be described in that context. As will become apparent, however, the injector pump of the invention may be employed for pumping viscous slurries other than concrete, and the described environment is illustrative of only one utility of the invention.

Figure 1:
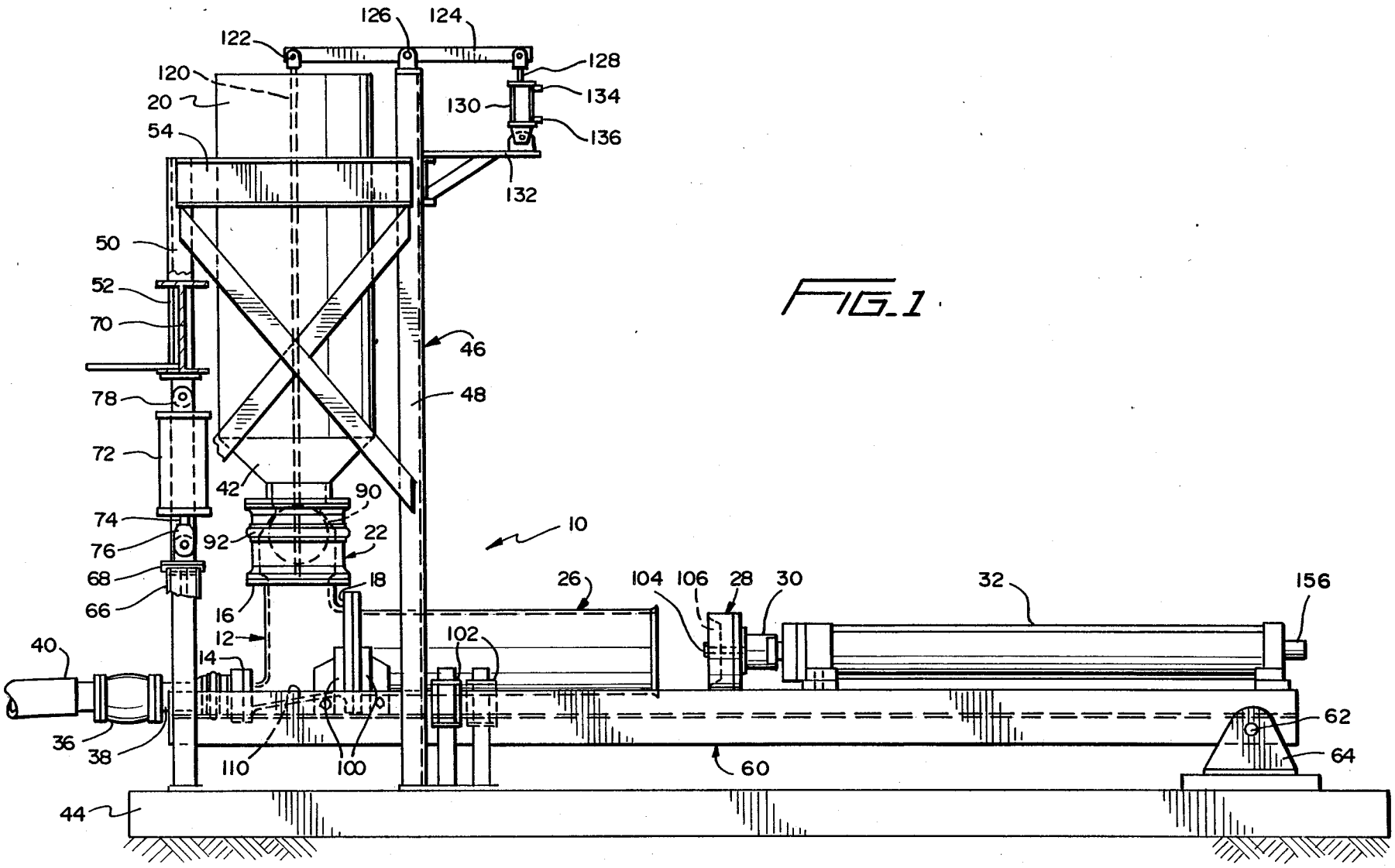
FIG. 1 is a side elevational view, partially broken away, of a concrete injector pump in accordance with the invention.

Referring to FIG. 1, there is illustrated a preferred embodiment of an injector pump 10 in accordance with the invention. Pump 10 is capable of the surgeless pumping of a viscous slurry, such as concrete or the like, at a controlled pump pressure and flow rate, and is capable of delivering a predetermined quantity of material at a constant pressure and flow rate over one pump stroke or cycle, as will be explained. As shown in the figure, pump 10 may comprise a casting or fitting 12 which forms an enclosure that encloses a pump chamber having an outlet 14 and first and second inlets 16 and 18, respectively. Concrete or other slurry material may be supplied to the chamber via the first inlet 16 from a hopper 20 via a fill valve 22, which is shown in more detail in FIG. 3 and which will be described hereinafter. Inlet 18 of the casting may be connected to an injector tube 26 which is sized and positioned to receive a piston 28 carried by a moveable piston rod or plunger 30 of a control cylinder 32. Cylinder 32 is preferably a hydraulic cylinder, although it may also be a pneumatic cylinder or an electro-mechanical element. The piston is adapted to sealingly and slideably engage the inner surface of injector tube 26, as will be explained, and to be positioned axially within the tube at a desired position by the hydraulic cylinder. Outlet 14 of the casting may be connected to an outlet line 40 via a pinch-type check valve 36 and an extension fitting 38, as shown.

Figure 2:
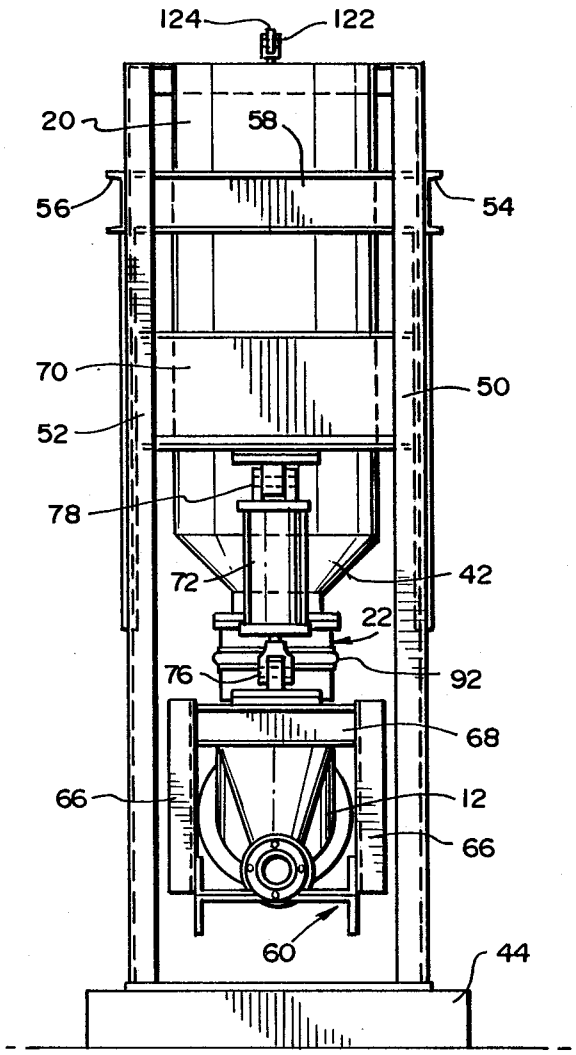
FIG. 2 is an end elevational view of the pump of FIG. 1.

Hopper 20, may comprise a cylindrical container having a funnel-shaped bottom 42 which connects to inlet 16 via the fill valve 22. The hopper may be supported on a base 44 in a substantially vertical position (as shown in FIGS. 1 and 2) by an open frame structure 46. As shown, frame 46 may comprise a plurality of upstanding vertical members 48, 50 and 52 which are rigidly interconnected together by a plurality of cross members 54, 56 and 58, as shown. Casting 12, along with injector tube 26 and hydraulic cylinder 32 which are connected to inlet 18, and fitting 38 and pinch valve 36 which are connected to outlet 14, may be supported on a second generally horizontal frame 60 which has one end (the right end in FIG. 1) pivotally connected at 62 to a pivot bracket 64 which is supported on base 44.

As best illustrated in FIG. 2, the opposite end (the left end in FIG. 1) of the horizontal frame 60 may be connected to a vertically oriented frame comprising a pair of vertical side frame members 66 and an upper cross member 68. Cross member 68 may be connected to another cross member 70 of frame 46 by means of a control cylinder 72, which is preferably an air-operated cylinder, although other types of pneumatic, hydraulic or electric control elements may also be employed. Frame 68 may be connected to the moveable piston rod 74 of the air cylinder by a clevis member 76, and the air cylinder itself may be connected to cross member 70 by another clevis member 78. As will be explained in more detail shortly, the air cylinder constitutes controllable positioning means for frame 60. Upon the air cylinder being operated to extend or retract the piston rod, frame 60 may be pivoted about pivot pin 62 to lower or raise the left end of frame 60 relative to the hopper. The purpose of this arrangement is to enable the pump to be cleaned, as will be described in more detail shortly.

Figure 3:
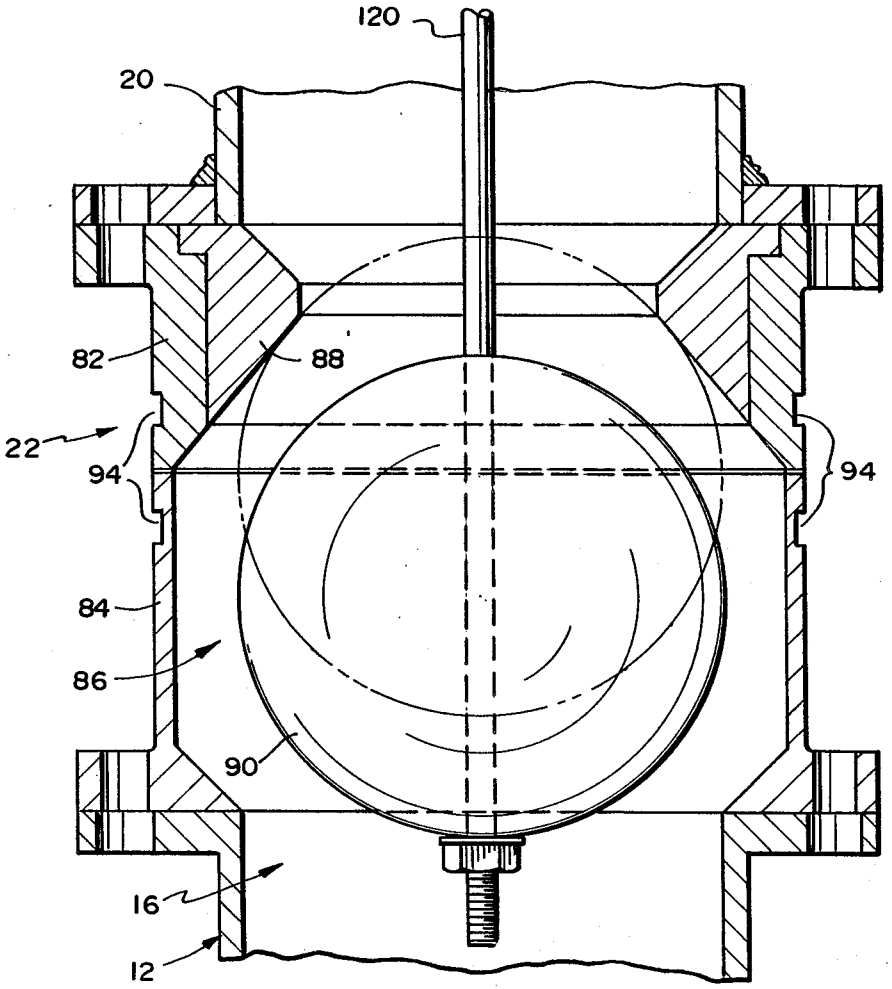
FIG. 3 is an enlarged sectional view of a ball check fill valve of the pump of FIGS. 1 and 2 which employs a split valve housing.

FIG. 3 illustrates fill valve 22 in more detail. As shown, the valve preferably comprises a split valve housing comprising an upper housing portion 82 and a lower housing portion 84 which are connected, respectively, to hopper 20 and to casting 12. As indicated in FIG. 3, the valve housing portions provide a passageway 86 between the hopper and the chamber formed in casting 12. The upper valve housing portion 82 may include a generally frustro-conically shaped valve seat 88 within passageway 86 which is formed to cooperate with a moveable check valve element 90, such as a ball, to open and close the passageway. The upper and lower valve housing portions may be connected together by a quick disconnect band-type coupling 92 (see FIGS. 1 and 2), such as a Victraulic coupling. Circumferentially extending grooves 94 may be formed in the upper and lower valve housing portions, as shown in FIG. 3, for cooperation with the quick-disconnect coupling 92 to facilitate connecting the valve housing portions together in axial alignment. (The coupling is not illustrated in FIG. 3.)

The split valve housing of fill valve 22 is a significant aspect of the invention. As may be appreciated, when quick-disconnect coupling 92 is uncoupled from the valve housing portions 82 and 84, the portions may be separated to gain access to the interior of the valve. When air cylinder 72 is operated, piston rod 74 extends. This causes frame 60 to pivot about pivot pin 62 so that the left end of the frame (in FIG. 1) pivots downwardly. This separates the two parts of the valve housing from one another and effectively opens the valve chamber to afford access to passageway 86, to valve element 90, and to the interior of the pump. This enables the interior of the pump to be flushed with water to remove concrete and facilitates cleaning or maintenance of the pump. As shown in FIG. 1, casting 12 and injector tube 26 may be connected to frame 60 by means of supports 100, and base 44 may be provided with guides 102 for guiding the frame as it is raised and lowered.

As is also shown in FIG. 1, hydraulic cylinder 32 is preferably positioned with respect to injector tube 26 such that when piston rod 30 is fully retracted piston 28 is withdrawn completely from the injector tube, as shown. This further facilitates cleaning of the pump since it affords access to the interior of the injector tube and to the chamber in casting 12 to enable them to be flushed with water, and is convenient for enabling maintenance to be performed on the piston 28.

As indicated in FIG. 1, piston 28 is preferably formed as a C-shaped cup member, as of rubber, which is connected to the end of piston rod 30 by a bolt 104 and a frustroconically shaped end cap 106 which fits into a similarly shaped recess in the end of the piston. When bolt 104 is tightened, the end cap is forced into the recess in the end of the piston, which causes the piston to expand sideways and its diameter to increase. This enables easy adjustment of the piston diameter in order to afford a good seal with respect to the inner diameter of the injector tube, and enables pump wear due to abrasive slurries to be easily compensated.

In operation, injector tube 26 is loaded or charged with concrete by opening fill valve 22, closing pinch valve 36, and moving piston 28 in an outward direction (to the right in FIG. 1) within injector tube 26. This draws concrete from hopper 20 into the chamber in casting 12 and into the injector tube. The concrete is ejected from the pump by opening pinch valve 36, closing fill valve 22, and operating hydraulic cylinder 32 to move the piston inwardly (to the left in FIG. 1). This forces the concrete in the chamber of casting 12 and in the injector tube outwardly through the pinch valve and line 40. As may be appreciated, the quantity of concrete ejected from the pump, as well as the flow rate, may be controlled by controlling the distance which piston 28 moves within the injector tube and the rate at which it moves. For lining pipe, injector tube 26 is sized so that it is large enough to hold at least the largest volume of concrete which would be needed for lining one pipe, and preferably so that it is large enough to hold the volume of concrete necessary for lining several pipes without recharging of the injector tube. This enables the required quantity of concrete for a lining to be delivered to the spray lance during one continuous inward stroke of the piston, which enables surgeless pumping since the concrete is supplied smoothly and continuously to the spray lance as the piston strokes inwardly.

A further advantage of the pump of FIG. 1 is that it enables precise control of the starting and stopping of concrete flow from the pump, without the lag time which is associated with other known types of slurry pumps. This enables accurate delivery of the concrete to the spray lance and close control over the lining operation. Since the delivery of concrete is a function of the movement of the piston, a further advantage of the pump is that the speed of the inward stroke of the piston can be varied, as desired, to afford a varying flow rate from the pump, which could be useful for accommodating variations in the rate of advancement of the spray lance into the pipe. Moreover, as the pump wears, the flow rate does not change, and there is no need to compensate for a variation in flow rate, since the flow rate is controlled entirely by the movement of the piston 28 which, in turn, is controlled by controlling the hydraulic cylinder 32.

As can be seen in FIG. 1, outlet 14 of casting 12 is at a lower level than inlet 18 from the injector tube, and the inlet and outlet are connected by a generally straight chamber wall 110 which slopes downwardly from inlet 18 to outlet 14. Thus, there are no crevices or depressions between inlet 18 and outlet 14 in which concrete could collect. This arrangement avoids any possible buildup of sand within the chamber or within the injector tube. When concrete is pumped, sand tends to separate from the mortar mixture. The sand tends to collect and buildup within a typical pump, which can reduce the pump chamber volume and result in blockage of the exit port. In the pump of the invention, by providing the exit of the pumping chamber at a lower level than the inlet, there is no opportunity for sand to buildup in the pump since any sand separated from the mixture is ejected along with the concrete mixture itself. A further advantage is that the pump is not limited to certain mixture parameters, such as sand-to-cement ratios, but can be used with a wide variation in mixture parameters. Some conventional concrete pumps do not function well when the sand-to-cement ratio exceeds approximately 1:1. By enabling a higher sand-to-cement ratio to be pumped, the invention reduces the amount of cement used and, accordingly, reduces lining costs.

As indicated above, the invention enables rather precise control over the starting and stopping of concrete flow from the pump since this is controlled by the movement of the piston within the injector tube. In order to improve pump operation, fill valve 22 of the pump is preferably provided with a mechanism for positively opening and closing the fill valve rather than merely relying upon pump pressure for moving the ball check element 90. As shown in FIGS. 1 and 3, this may be accomplished by connecting the ball check element 90 to a pull rod 120 which extends downwardly through the hopper and into the fill valve. The upper end of the pull rod may be connected by a clevis 122 to one end of a member 124 which is pivoted at 126 to frame member 48. The opposite end of the member may be connected to the moveable piston rod 128 of a control element such as an air cylinder 130 which is connected by means of a bracket 132 to frame 46. Cylinder 130 may be a conventional air cylinder which incorporates limit switches 134 and 136 which indicate the piston rod positions corresponding to the fill valve open and closed positions. By controlling the supply of air to the cylinder, piston rod 128 may be moved inwardly or outwardly to pivot member 124 and move the pull rod. This moves ball 90 into or out of engagement with valve seat 88 of the fill valve to open and close the valve. This enables the valve to be positively opened and closed, which affords good predictability and control of the quantity and flow rate from the pump.

Figure 4:
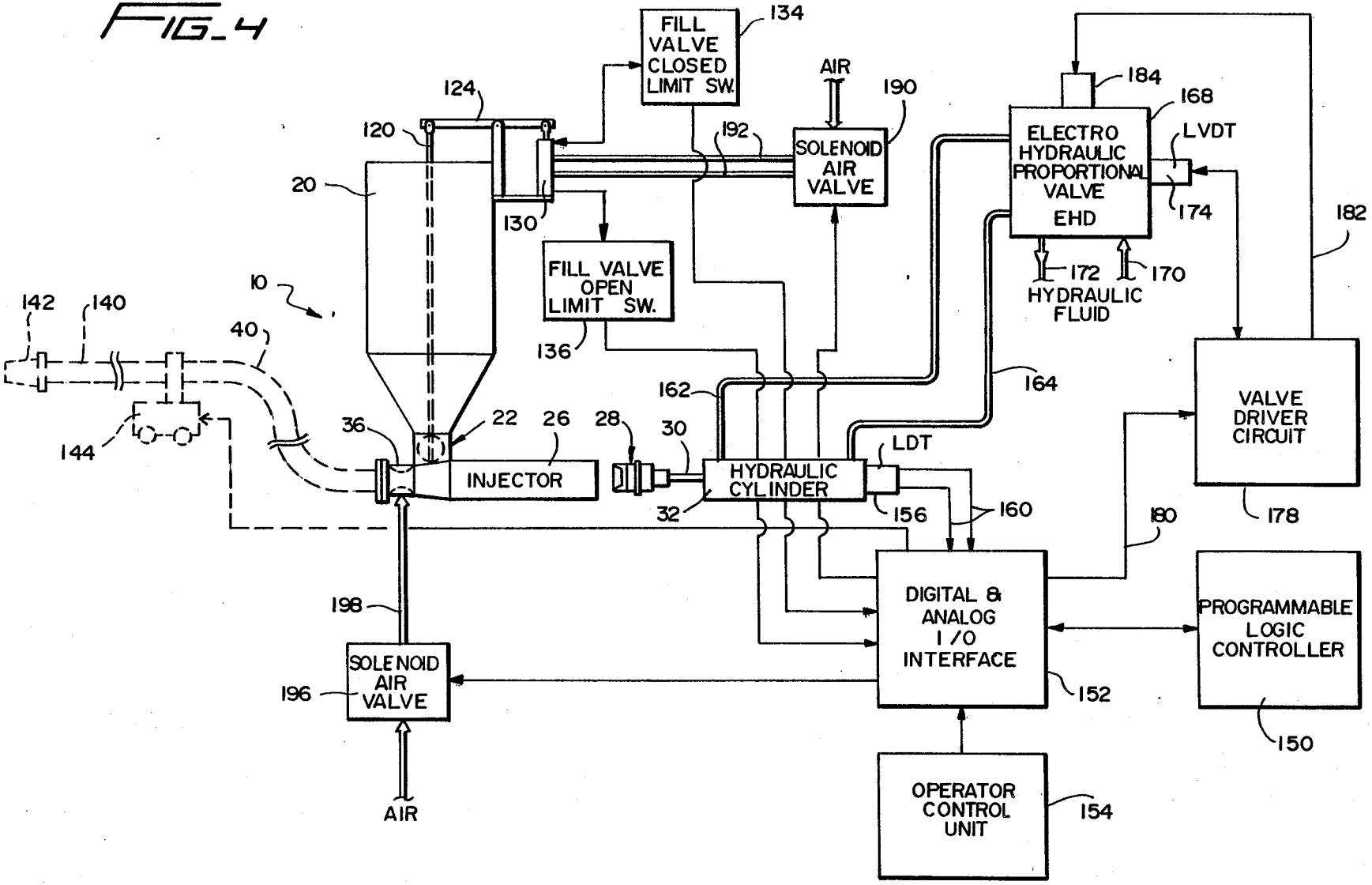
FIG. 4 is a diagrammatic view of pipe lining apparatus in accordance with the invention comprising the injector pump of FIGS. 1 and 2 and a control system for controlling the pump.

FIG. 4 illustrates diagrammatically pump 10 in combination with a computerized control system for controlling the pump operation, and shows (in dotted lines) the pump connected to a spray lance 140 having a spray nozzle 142 on its end. The spray lance may be advanced into the interior of a length of pipe to be lined by a moveable lining car 144, which may ride on tracks and the movement of which may be controlled by the control system (as indicated by the dotted line to the car).

As shown, the control system may comprise a computer or programmable logic controller 150, which may be conventional such as a Westinghouse model controller. The controller may be connected to a digital and analog input/output (I/O) interface unit 152 which interfaces the controller to various control elements in the system and to an operator control unit 154. The operator control unit enables entry of control parameters such as mode of operation, pump speed, pump start and stop positions, time parameters, pipe sizes, etc., and enables initiation and interruption of the delivery and refill cycles of the pump. The programmable logic controller 150 may embody an appropriate control program for calculating appropriate parameters for controlling the operation of the system n response to the operator entered parameters. The primary element which controls the operation of the pump itself is the hydraulic cylinder 32 which, as previously described, controls the movement of piston 28 within the injector tube 26. Hydraulic cylinder 32 may comprise a conventional hydraulic cylinder, such as a Parker model hydraulic cylinder having a six inch bore and a sixty inch stroke, for example, and which includes a transducer 156 such as a Parketron LDT position encoder which provides electrical signals via lines 160 to the digital and analog I/O interface unit 152 that represent the position of the piston and its speed of movement. Piston movement is controlled by hydraulic fluid applied to the hydraulic cylinder via lines 162 and 164 from an electro-hydraulic proportional control valve 168, such as a Parker EHD proportional valve and load sensing pump. The proportional valve is provided with inlet and return hydraulic lines 170 and 172 for hydraulic fluid, and may include an LVDT transducer 174 which provides feedback electrical signals representative of the valve position to an electronic valve driver circuit 178. Valve driver 178 receives electrical valve command signals via the digital and analog I/O interface unit 152 over a line 180, and the electrical signals from the LVDT transducer, and provides a valve drive signal via a line 182 to a valve drive element 184 of the valve 168. Valve 168 may be pressure compensated to insure cylinder speed repeatability with position by controlling the pump displacement in a load sensing mode wherein the differential pressure across the valve is held constant.

The controller 150 may also control, via the digital and analog I/O interface unit 152, a solenoid air valve 190 which supplies air via lines 192 to air cylinder 130 for positively opening and closing the fill valve 22 of the pump, as previously described. Electrical feedback signals from the fill valve closed limit switch 134 and fill valve open limit switch 136 of the air cylinder are used to indicate the position of the fill valve to the controller. Air cylinder 130 may also be a conventional Parker air cylinder having, for example, a two inch bore and a three inch stroke. Finally, the digital and analog I/O interface unit may supply signals to another solenoid air valve 196 which supplies air via a line 198 to pinch valve 36 for opening and closing the valve. When solenoid valve 196 is energized, air is supplied to the pinch valve and the pinch valve closes. The pinch valve may be a conventional valve comprising a cast iron body containing a neoprene sleeve which is opened and closed by air pressure.

The operation of the system illustrated in FIG. 4 will now be described. Starting with the injector tube 26 loaded and ready to deliver concrete and with lance 140 filled with concrete (as from a previous lining cycle) and properly positioned with respect to the pipe to be lined, fill valve 22 is first closed by sending a signal from the digital and analog I/O interface unit 152 to solenoid valve 190 to operate air cylinder 130. Next, a signal is supplied to solenoid valve 196 to open pinch valve 36, and the proportional valve 168 is centered for no motion of the hydraulic cylinder piston 30.

A delivery cycle starts based upon the position of the lining car 144 relative to the pipe. The programmable logic controller 150 commands the proportional valve 168 via the digital and analog I/O interface unit 152 and valve driver 178 to a preset delivery position. This supplies hydraulic fluid to hydraulic cylinder 32 at a predetermined rate, which causes piston 28 to extend at a corresponding rate to execute an inward stroke (into the injector tube). This forces concrete from the injector tube and the chamber out through line 40 and spray lance 140. During the lining cycle, the inward stroke of the piston comprises a single continuous inward motion of the piston, which produces a surgeless constant flow rate from the pump. The amount of inward movement and the rate of movement is controlled in accordance with the parameters entered by the operator via the operator control unit 154 so that a predetermined amount of concrete is delivered to the pipe in order to afford a lining having a predetermined thickness. The amount of movement of the piston is determined by the amount of concrete required for lining a pipe having a given diameter and length, and the rate of movement is determined by the rate of advancement of the lance into the pipe so that the delivery of the concrete through the spray lance is synchronized with the advancement of the spray lance into the pipe. At the end of the delivery cycle, the proportional valve is controlled to interrupt the movement of the piston of the hydraulic cylinder. If injector tube 26 is sized to enable lining of several different pipes without refilling, the next lining sequence merely requires that the hydraulic cylinder be again operated to move the piston inwardly by the required amount and at the required rate for the next pipe to be lined.

To refill the injector tube with concrete, the controller 150 issues appropriate signals to solenoid valve 196 to close pinch valve 36 and to solenoid valve 190 to open fill valve 22. When limit switch 136 indicates that the fill valve is open, controller 150 issues a signal via valve driver 178 to the proportional valve 168 to retract the piston to a desired position. This draws concrete from the hopper into the chamber and injector tube until a preset stop position is reached, as is indicated to the controller by the LDT transducer 156. At this point, the piston is stopped and the fill and pinch valves are reset to the delivery positions and the system is ready for the next lining operation.

For cleaning and/or maintenance, piston 28 is retracted completely from injector tube 26, as previously described, the quick-disconnect coupling holding the two portions of the fill valve housing together is disconnected, and air cylinder 72 is operated to extend its piston 74 and pivot frame 60 about pivot pin 62 to lower casting 12 and injector tube 26, as previously described. After cleaning and/or maintenance has been completed, the operation is reversed and the pump is reassembled. As may be appreciated, the construction of the pump is such that it may be disassembled for cleaning and maintenance very easily.

As may be appreciated, programmable logic controller 150 may embody control programs for appropriately controlling the system of FIG. 4 in response to a wide range of parameters input by the operator via the operator control unit 154. This enables the system to line different sized pipe and to provide different thicknesses of lining readily. The control programs of the controller may automatically calculate the required parameters for controlling the system based upon the parameters input by the operator. The controller may also provide an appropriate output to displays on the operator control unit as, for example, for indicating the delivered volume of lining material, its weight, and the nominal lining thickness.

From the foregoing, it will be appreciated that the pump and system of the invention may be employed for pumping other types of viscous slurries, e.g., epoxy coal tar, and may be employed for purposes other than lining pipe.

While a preferred embodiment of the invention has been shown and described, it will be appreciated by those skilled in the art that changes may be made in this embodiment without departing from the principles and spirit of the invention, the scope of which is defined in the appended claims.

What is claimed:

1. A pump for a viscous slurry comprising an enclosure enclosing a chamber having an outlet and first and second inlets; a hopper for the slurry; a fill valve disposed between the first inlet and the hopper, the fill valve comprising a valve housing providing a passageway between the hopper and the first inlet and enclosing a moveable check valve element for opening and closing the passageway, the valve housing being split and separable into parts to afford access to the valve element; an injector tube connected to the second inlet, the injector tube having a moveable plunger disposed therein; and means for moving the plunger in a first direction to draw into the tube and into the chamber through the fill valve a quantity of the slurry and for moving the plunger in a second direction to eject the slurry from the outlet.

2. The pump of claim 1, wherein the moving means includes means for controlling the movement of the plunger in the first direction to draw into the injector tube and chamber from the hopper a first predetermined quantity of slurry, and means for controlling the movement of the plunger in the second direction to eject a second predetermined quantity of slurry from the outlet.

3. The pump of claim 2, wherein the controlling means includes means for varying the speed of movement of the plunger in the second direction in order to vary the rate at which slurry is ejected from said outlet.

4. The pump of claim 3, wherein said moving means comprises a hydraulic cylinder, the moveable plunger comprising a piston disposed on a moveable piston rod of the hydraulic cylinder, the hydraulic cylinder having a transducer which provides a signal representative of the position and the movement of the piston rod, and wherein the controlling means comprises means responsive to the signal from the transducer for controlling the amount of movement and the rate of movement of the piston rod in the second direction.

5. The pump of claim 4, wherein the controlling means comprises a programmable logic controller embodying means responsive to operator-entered parameters for controlling the movement of the piston rod.

6. The pump of claim 1, further comprising a quick-disconnect coupling for holding the parts of the split valve housing together, and means operable upon disconnection for separating the parts of the valve housing from one another.

7. The pump of claim 6, wherein the hopper and a first part of the valve housing are supported in a fixed position by a first frame, the enclosure, injector tube, moving means, and a second part of the split valve housing being supported on a second frame which is pivotally mounted on a base, and wherein said means for separating the parts comprises an air cylinder for pivoting the second frame to move the first and second parts of the valve housing relative to one another.

8. The pump of claim 1, further comprising means responsive to the movement of the plunger in the first and second directions for operating the moveable check valve element to positively open and close, respectively, the passageway.

9. The pump of claim 8, wherein the operating means comprises a first moveable member, a second member connected to the first moveable member and to the moveable check valve element, and means for moving the first member so as to move the check valve element to open and close positively the valve.

10. The pump of claim 1, further comprising a pinch valve located at said outlet, and means for operating the pinch valve to close the outlet upon movement of the plunger in the first direction and to open the outlet upon movement of the plunger in the second direction.

11. An apparatus for lining pipe comprising a spray lance insertable into the interior of a length of pipe for depositing lining material into the interior; means for advancing the spray lance into the pipe at a controlled rate; pump means for supplying lining material to the lance, the pump means comprising an enclosure enclosing a pump chamber having an outlet connected to the lance and having first and second inlets, a hopper for the lining material, a split-bodied check valve disposed between the hopper and the first inlet, an injector tube having a moveable plunger therein connected to the second inlet; and means for controlling the moveable plunger such that a first predetermined quantity of lining material is drawn into the chamber and into the injector tube through the check valve upon movement of the plunger in a first direction and such that the movement of the plunger in a second direction is controlled so as to eject a second predetermined quantity of lining material from the outlet.

12. The apparatus of claim 11, wherein said controlling means comprises means for controlling the insertion of the spray lance into the length of pipe, and means for controlling the movement of the plunger in the second direction in synchronism with the insertion of the lance such that the second predetermined quantity of lining material ejected form the outlet is deposited into the interior of the pipe at a predetermined rate and so as to afford a lining having a predetermined thickness.

13. The apparatus of claim 12, wherein the injector tube is sized such that the first predetermined quantity of lining material is equal to or greater than the second predetermined quantity of lining material, and wherein the controlling means includes means for moving the plunger continuously in the second direction during the insertion of the lance into the pipe in order to provide a surgeless supply of lining material to the lance.

14. The apparatus of claim 13, wherein the controlling means comprises a programmable controller responsive to operator-entered parameters relating to the size of the pipe and the desired lining thickness for controlling the insertion of the lance into the interior of the pipe and the movement of the plunger to provide a required quantity and flow rate of lining material to give a lining having the desired thickness.

15. The apparatus of claim 11, wherein the split-body valve comprises housing having first and second separable portions such as to afford access to this interior of the valve and pump means.

* * * * *